US007420436B2

(12) United States Patent
Stenger

(10) Patent No.: US 7,420,436 B2
(45) Date of Patent: Sep. 2, 2008

(54) TRANSMISSION LINE TO WAVEGUIDE TRANSITION HAVING A WIDENED TRANSMISSION WITH A WINDOW AT THE WIDENED END

(75) Inventor: Peter A. Stenger, Woodbine, MD (US)

(73) Assignee: Northrop Grumman Corporation, Los Angeles, CA (US)

( * ) Notice: Subject to any disclaimer, the term of this patent is extended or adjusted under 35 U.S.C. 154(b) by 102 days.

(21) Appl. No.: 11/373,983

(22) Filed: Mar. 14, 2006

(65) Prior Publication Data

US 2007/0216493 A1 Sep. 20, 2007

(51) Int. Cl.
*H01P 5/107* (2006.01)

(52) U.S. Cl. ..... 333/26; 333/34

(58) Field of Classification Search ..... 333/26, 333/34

See application file for complete search history.

(56) References Cited

U.S. PATENT DOCUMENTS

| | | | | |
|---|---|---|---|---|
| 4,453,142 | A | 6/1984 | Murphy | |
| 5,198,786 | A | 3/1993 | Russell et al. | |
| 5,202,648 | A | 4/1993 | McCandless | |
| 5,278,575 | A | 1/1994 | Thomas | |
| 5,414,394 | A | 5/1995 | Gamand et al. | |
| 5,600,286 | A | 2/1997 | Livingston et al. | |
| 5,770,981 | A * | 6/1998 | Koizumi et al. | 333/26 |
| 5,912,598 | A | 6/1999 | Stones et al. | |
| 5,943,005 | A | 8/1999 | Tanizaki et al. | |
| 6,002,305 | A * | 12/1999 | Sanford et al. | 333/26 |
| 6,127,901 | A | 10/2000 | Lynch | |
| 6,144,266 | A | 11/2000 | Heidemann et al. | |
| 6,268,781 | B1 | 7/2001 | Schaffner | |
| 6,396,364 | B1 * | 5/2002 | Qvist | 333/26 |
| 6,466,101 | B2 | 10/2002 | Tanji | |
| 6,788,171 | B2 | 9/2004 | Ammar et al. | |
| 6,788,918 | B2 | 9/2004 | Saitoh et al. | |
| 6,794,950 | B2 | 9/2004 | du Toit et al. | |
| 6,822,528 | B2 | 11/2004 | Dawn et al. | |
| 6,967,543 | B2 | 11/2005 | Ammar | |
| 2002/0047038 | A1 | 4/2002 | Sangawa et al. | |
| 2002/0097109 | A1 | 7/2002 | du Toit et al. | |
| 2002/0163397 | A1 | 11/2002 | Buck | |
| 2003/0011517 | A1 | 1/2003 | Kolak et al. | |
| 2003/0122634 | A1 | 7/2003 | Golf | |
| 2003/0141940 | A1 | 7/2003 | Le Bihan et al. | |
| 2003/0231078 | A1 * | 12/2003 | Koriyama et al. | 333/26 |
| 2004/0041651 | A1 | 3/2004 | Shono | |

(Continued)

OTHER PUBLICATIONS

Iizuka, H., et al., "Milimeter-Wave Microstrip Line to Waveguide Transistion Fabricated on a Single Dielectric Substrate", R&D Review of Toyota CRDL vol. 37, No. 2, Apr. 23, 2002, pp. 13-18.

Kim, J., et al., "A Novel Microstrip to Coplanar Waveguide Transistion for Flip-Chip Interconnection Using Electromagnetic Coupling", Dept. of Elec. Engineering, Univeristy of CA, Los Angeles, CA, pp. 1-5.

(Continued)

*Primary Examiner*—Benny Lee
(74) *Attorney, Agent, or Firm*—Rothwell, Figg, Ernst & Manbeck

(57) ABSTRACT

In one aspect, an embodiment of the invention provides a transition from a planar substrate/chip circuit microwave transmission line to waveguide transmission media on the back of the substrate/chip. The transition enables planar waveguide fed MMW ESA architectures to be realized within the tight grid spacing required for emerging MMW ESAs.

23 Claims, 9 Drawing Sheets

U.S. PATENT DOCUMENTS

| | | | | |
|---|---|---|---|---|
| 2004/0080377 | A1 * | 4/2004 | Chang et al. | 333/26 |
| 2004/0085151 | A1 | 5/2004 | Fukunaga | |
| 2004/0183621 | A1 | 9/2004 | Lo Hine Tong et al. | |
| 2004/0263280 | A1 | 12/2004 | Weinstein | |
| 2005/0040911 | A1 | 2/2005 | Lenz | |
| 2005/0163456 | A1 | 7/2005 | Munk | |

OTHER PUBLICATIONS

Kooi, J.W., et al. "A Full-Height Waveguide to Thin-Film Microstrip Transistion with Exceptional RF Bandwidth and Coupling Efficiency", IR & MM Waves, vol. 24, No. 3, Califonrnia Institute of Technology, Pasadena, CA, 2003, pp. 261-284.

* cited by examiner

TRANSMISSION LINE TO WAVEGUIDE TRANSITION HAVING A WIDENED TRANSMISSION WITH A WINDOW AT THE WIDENED END

BACKGROUND OF THE INVENTION

1. Field of the invention

The field of the invention relates to transmission line waveguide transitions.

2. Discussion of the Background

Conventional interconnects for connecting a transmission line to a waveguide, such as, for example, lateral off chip ribbon interconnects, are reflective to millimeter wave (MMW) signals due to large inductance, use precious lateral area, and are fragile and costly. Additionally, they are performance sensitive for practical applications in emerging MMW electronically scanned arrays (ESAs).

SUMMARY OF THE INVENTION

The present invention aims to overcome at least some of the above described and/or other disadvantages of conventional interconnects. In one aspect, an embodiment of the invention provides a transition from a planar substrate/chip circuit microwave transmission line to waveguide transmission media on the back of the substrate/chip. The transition enables planar waveguide fed MMW ESA architectures to be realized within the tight grid spacing required for emerging MMW ESAs.

A system according to one aspect of the invention the invention provides an apparatus for use in electronic systems such as, for example, radar systems, communication systems and/or other electronic systems. In some embodiments, the apparatus includes, a first substrate; a first transmission line disposed on a top surface of the first substrate; a second substrate; a ground plane disposed between a bottom surface of the first substrate and a top surface of the second substrate; a third substrate having a top surface that faces the bottom surface of the second substrate; a second transmission line, having a first end and a second end, disposed between the bottom surface of the second substrate and the top surface of the third substrate, wherein the second transmission line widens from the first end to the second end; a via in contact with an end of the first transmission line and in contact with the first end of the second transmission line, wherein the via passes through the first substrate, the ground plane and the second substrate; and a window formed in the second end of the second transmission line.

In some embodiments, the apparatus further includes a window formed in the third substrate, wherein the window formed in the third substrate is directly beneath and aligned with the window formed in the second transmission line. Additionally, in some embodiments, the apparatus further includes a second ground plane attached to the bottom surface of the third substrate, wherein a window is formed in the ground plane and this window is directly beneath and aligned with the window formed in the third substrate.

The above and other features and advantages of the present invention, as well as the structure and operation of preferred embodiments of the present invention, are described in detail below with reference to the accompanying drawings.

BRIEF DESCRIPTION OF THE DRAWINGS

The accompanying drawings, which are incorporated herein and form part of the specification, help illustrate various embodiments of the present invention and, together with the description, further serve to explain the principles of the invention and to enable a person skilled in the pertinent art to make and use embodiments of the invention. In the drawings, like reference numbers indicate identical or functionally similar elements.

DETAILED DESCRIPTION OF PREFERRED EMBODIMENTS

Figure 1:
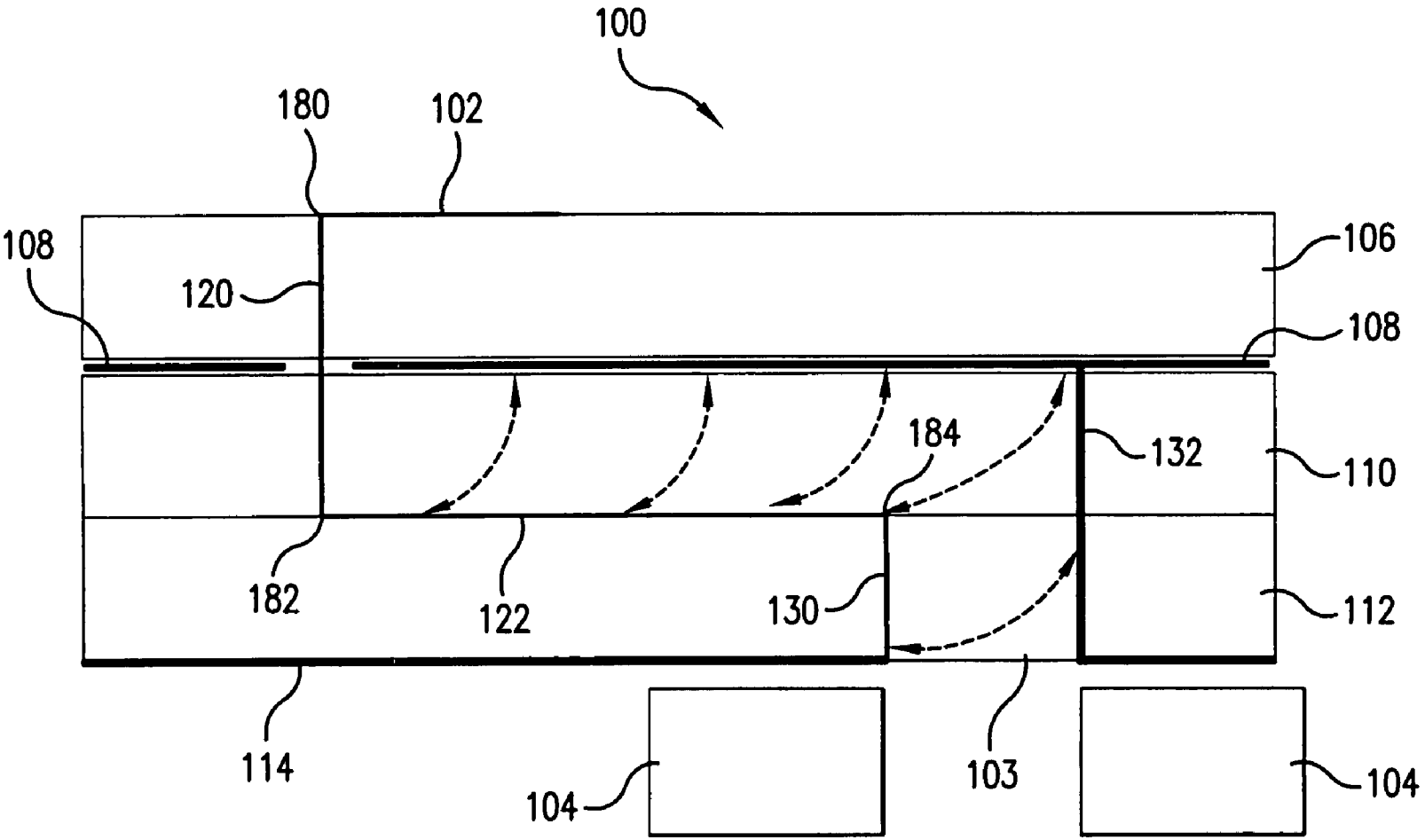
FIG. 1 illustrates a transmission line 102 to waveguide 104 transition.

FIG. 1 illustrates a transmission line 102 to waveguide 104 transition. More specifically, FIG. 1 is a cross-sectional view of a chip 100 and a waveguide 104, which is connected to the waveguide interface 103. In the embodiment shown, transmission line 102 is disposed on a surface of a substrate 106 (substrate 106 may be a GaAs substrate or other substrate), a ground plane 108 is disposed directly between the bottom of substrate 106 and a top surface of a substrate 110, a substrate 112 is connected to the bottom of substrate 110, and a second ground plane 114 is attached to the bottom of substrate 112. Substrates 110, 112 are preferably made from a dielectric material. For example, Benzocyclobutene (BCB) may be used to form substrates 110, 112.

As further shown in FIG. 1, a conductive pathway (e.g., a plated through hole or other conductive pathway) 120, which passes through substrates 106 and 110 and ground plane 108, is electrically connected between and end 180 of transmission line 102 and an end 182 of a transmission line 122, which is disposed between substrate 110 and substrate 112. Transmission line 122 may be printed on the bottom of substrate 110 or on the top of substrate 112.

A plurality of conductive pathways (or "Vias") 130, which pass through substrate 112, are electrically connected between an end of transmission line 122 and ground plane 114. Additionally, a plurality of vias 132, which pass through substrates 110 and 112, electrically connect ground plane 108 with ground plane 114.

As shown in FIG. 1, transmission line 122 connects into the broad wall of a fractional height waveguide structure. Ground plane 108 functions as the other broad wall of the waveguide. The vias are used to create the signal interconnect to the top side (a.k.a., "circuit side") of substrate 106 and to provide the metal walls of the waveguide. Preferably, the transition would be processed with the dielectric layers 110, 112 at the wafer level prior to dicing of the wafer. The dotted lines with arrows at the end represent the signal path.

An advantage of the interconnect design shown in FIG. 1 is that it does not take up space in a lateral area of the chip, unlike conventional off chip interconnects, which require lateral area. This enables MMW active ESA planar arrays near half-wavelength ($\lambda/2$) grid spacing.

Figure 2:
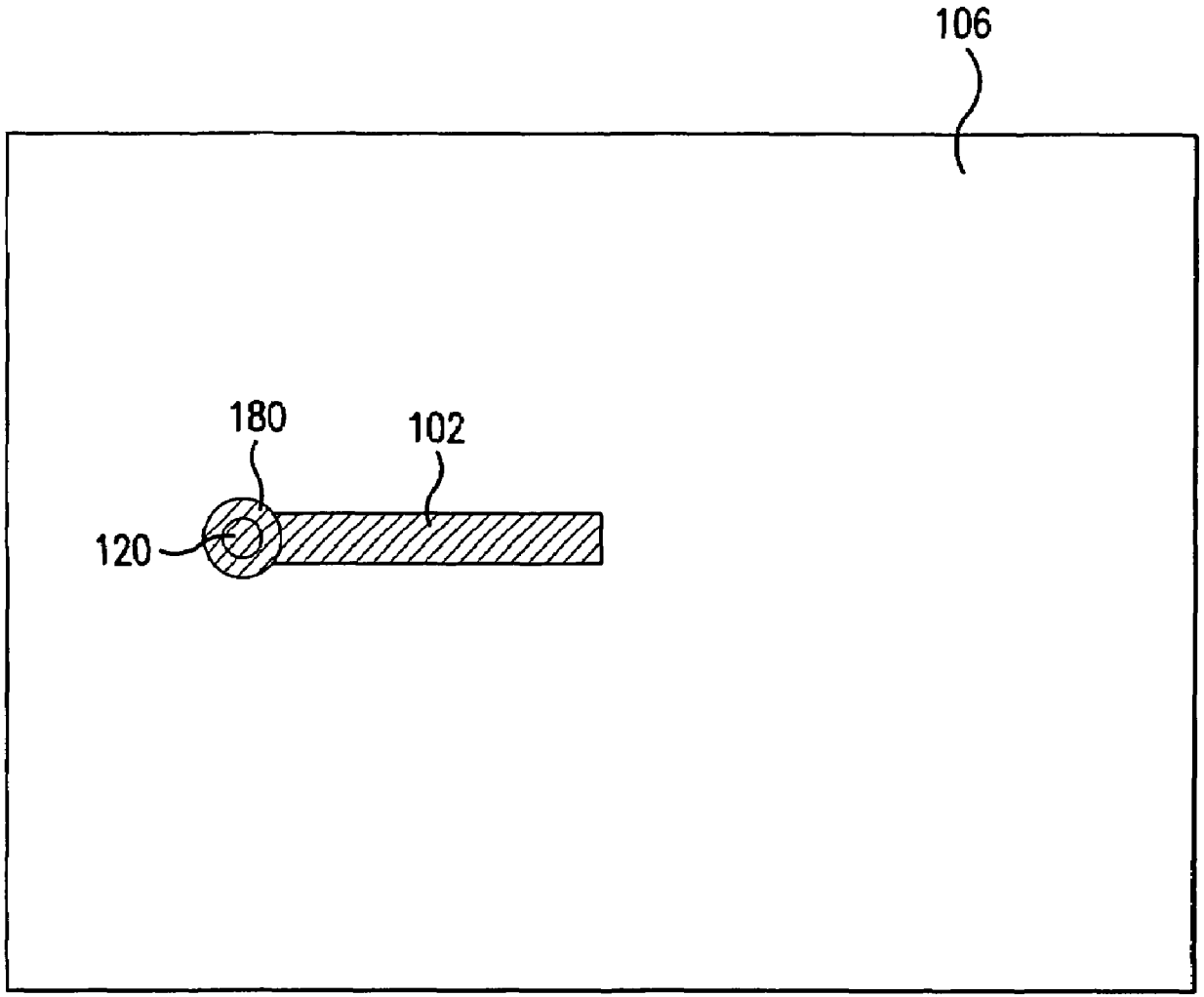
FIG. 2 shows a top view of substrate 106.

Referring now to FIG. 2, FIG. 2 shows a top view of substrate 106. As shown in FIG. 2, signal transmission line 102 is disposed on a top surface of substrate 106 and via 120, which is disposed at end 180 of transmission line 102, is used to provide a signal path to transmission line 122.

Figure 3:
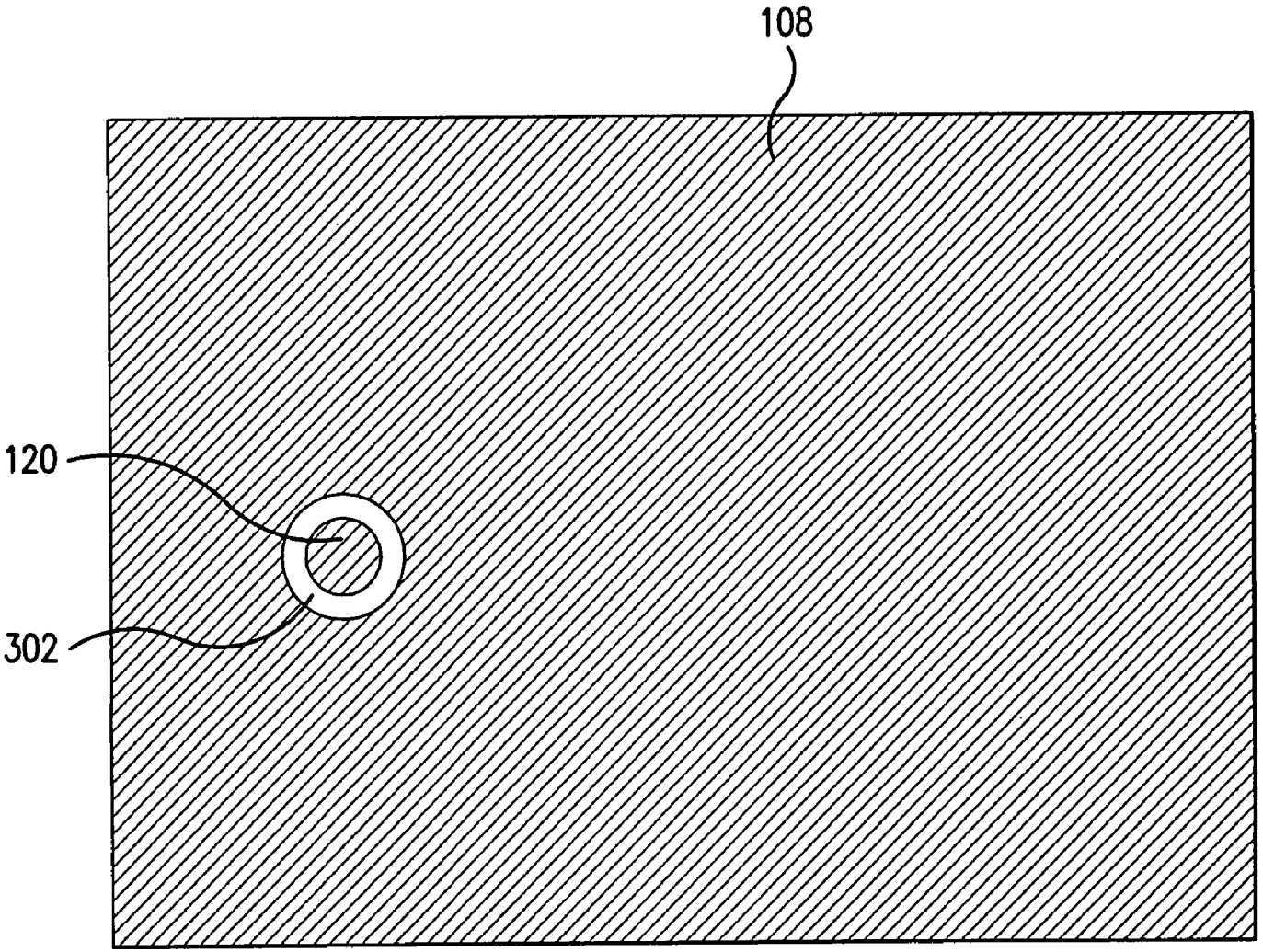
FIG. 3 shows a top view of ground plane 108.

Referring now to FIG. 3, FIG. 3 shows a top view of ground plane 108. As shown, ground plane 108 is formed from an electrically conducting material. As further shown, via 120 passes through and is isolated from ground plane 108 (i.e., there is an empty space 302 separating via 120 from ground plane 108.

Figure 4:
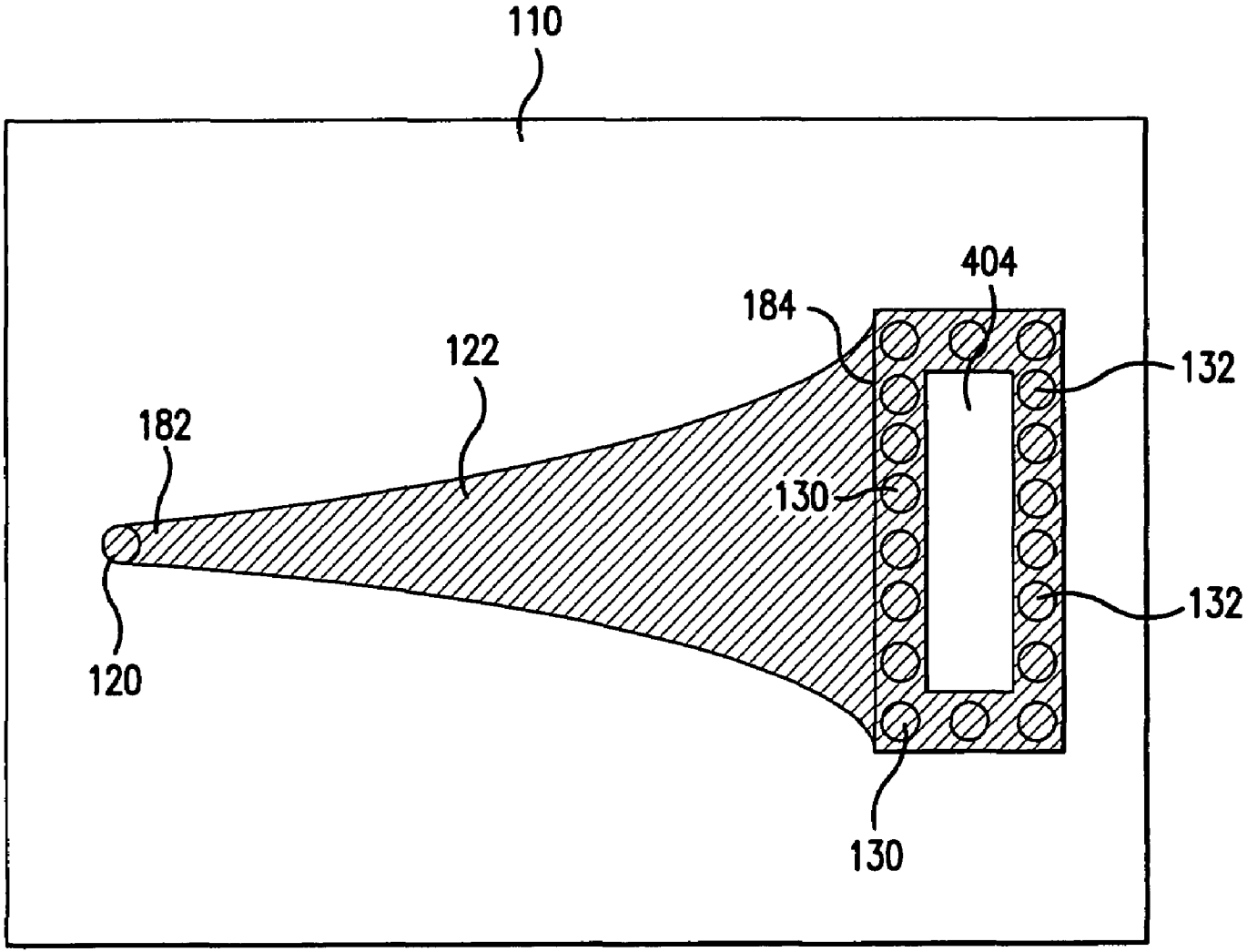
FIG. 4 shows a top view transmission line 122.

Referring now to FIG. 4, FIG. 4 shows a top view transmission line 122. As shown in FIG. 4, transmission line 122 widens from end 182 to end 184. The width of the wide end 184 is dependent upon a selected cutoff frequency for the waveguide performance. In one embodiment, if the width of narrow end 182 is a value X, then the width of end 184 may be a value about at least 5 times X. For example, in some embodiments, the width of end 182 may be about 0.005 inches and the width of end 184 may range between about 0.05 inches (i.e., 10×) and about 0.2 inches (i.e., 40×). In a preferred embodiment, as shown in FIG. 4, line 122 gradually widens from end 182 to end 184.

As further shown, a rectangular window 404 is formed in end 184 of transmission line 122 such that end 184 frames window 404. Further, vias 130, 132 surround the periphery of window 404. Some of the vias (i.e., vias 130) extend only downwardly with respect to transmission line 122 to electrically connect end 184 of transmission line 122 to ground plane 114, whereas other vias (i.e., vias 132) extend upwardly and downwardly with respect to transmission line 122 to electrically connect end 184 of transmission line 122 to ground plane 108 and ground plane 114. as best seen in FIG. 1.

Figure 5:
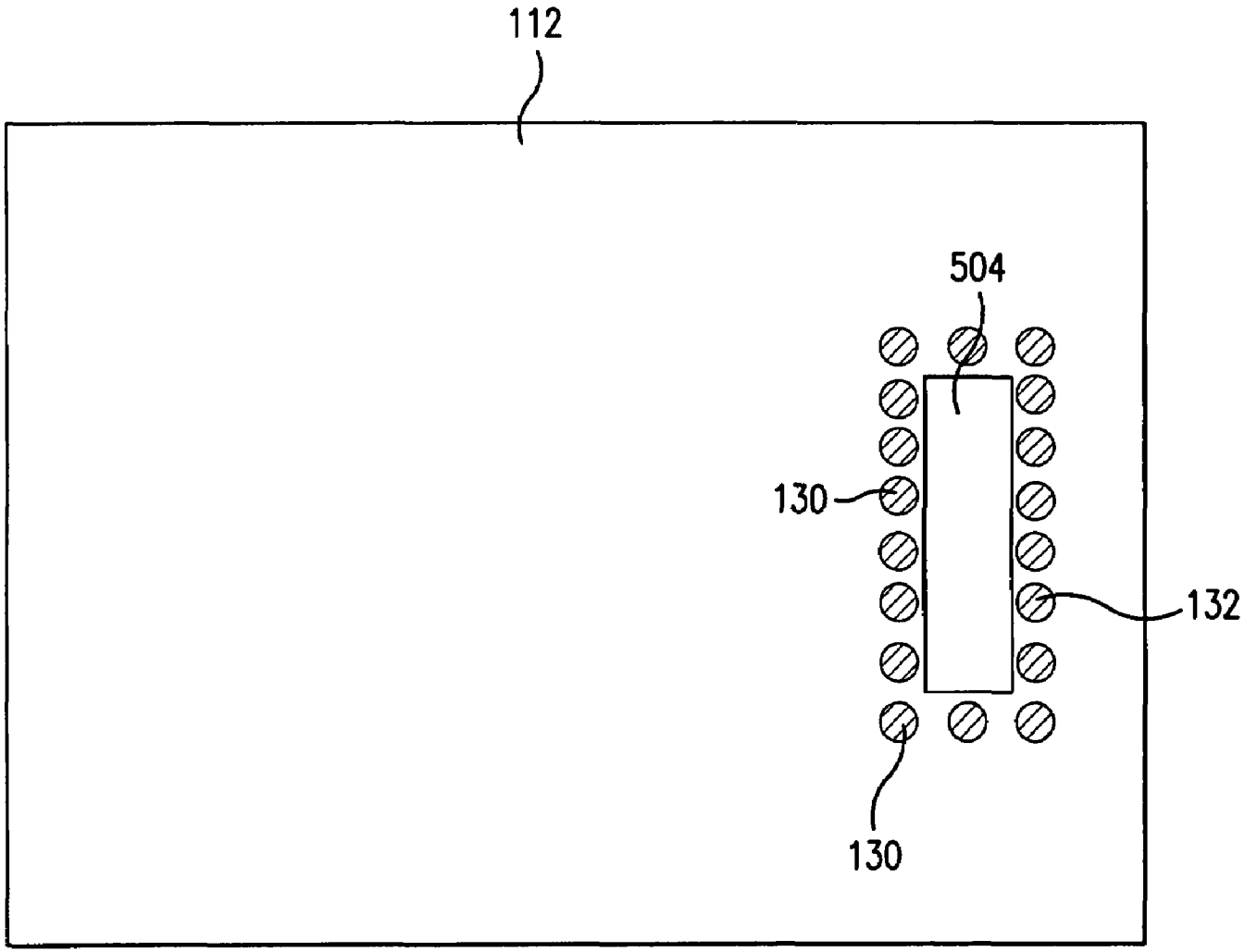
FIG. 5 shows a top (or bottom) view of substrate 112.

Referring now to FIG. 5, FIG. 5 shows a top (or bottom) view of substrate 112. As shown, a rectangular window 504 is formed in substrate 112. Window 504 may have the same width and length dimensions of window 404. Preferably, window 504 is aligned directly underneath window 404. As further shown, vias 130, 132 surround the periphery of window 504.

Figure 6:
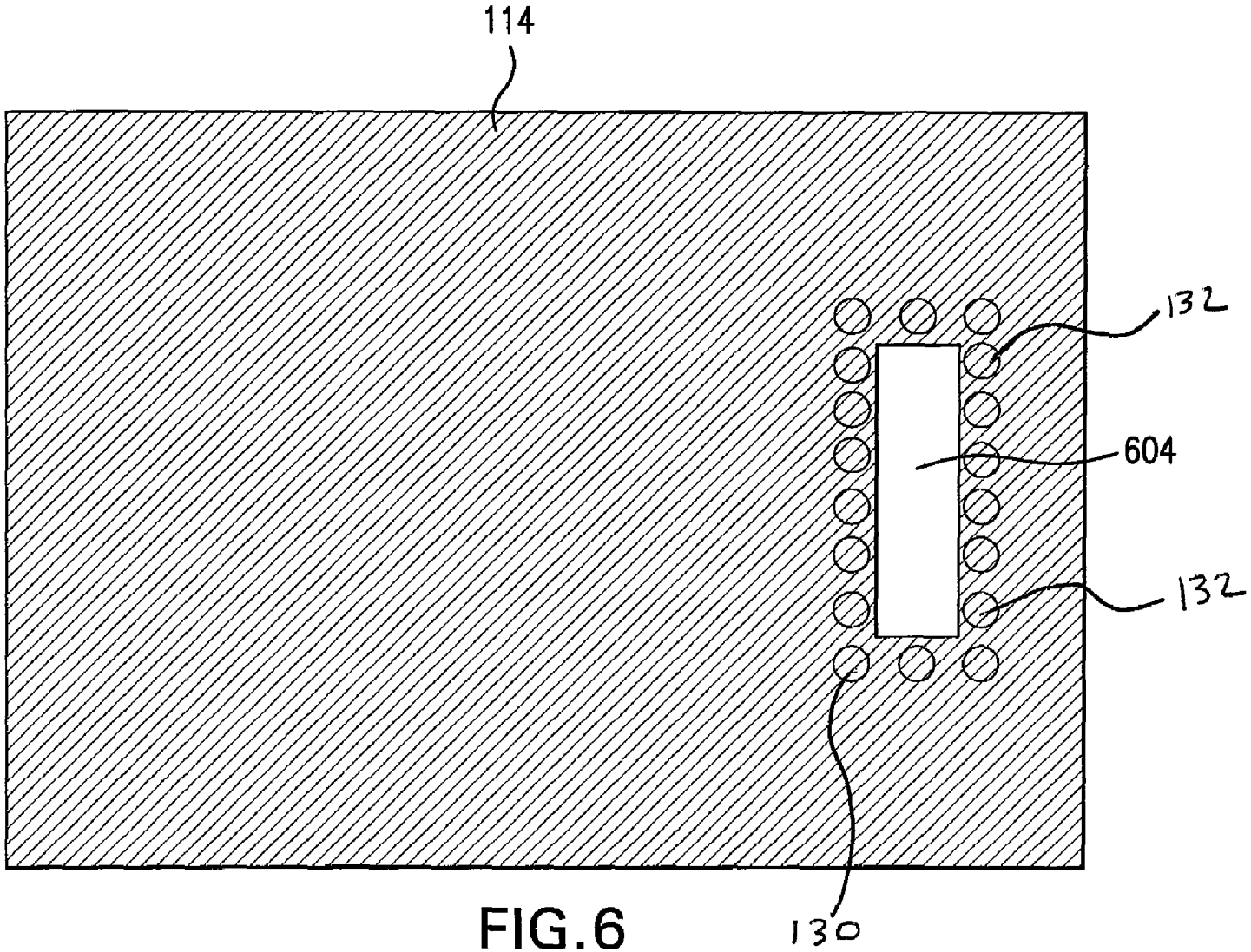
FIG. 6 shows a top (or bottom) view of substrate ground plane 114.

Referring now to FIG. 6, FIG. 6 shows a top (or bottom) view of substrate ground plane 114. As shown, a rectangular window 604 is formed in ground plane 114. Window 604 may have the same width and length dimensions of window 404 (see FIG. 4). Preferably, window 604 is aligned directly underneath window 504 (see FIG. 5). As further shown, vias 130, 132 surround the periphery of window 604.

Figure 7:
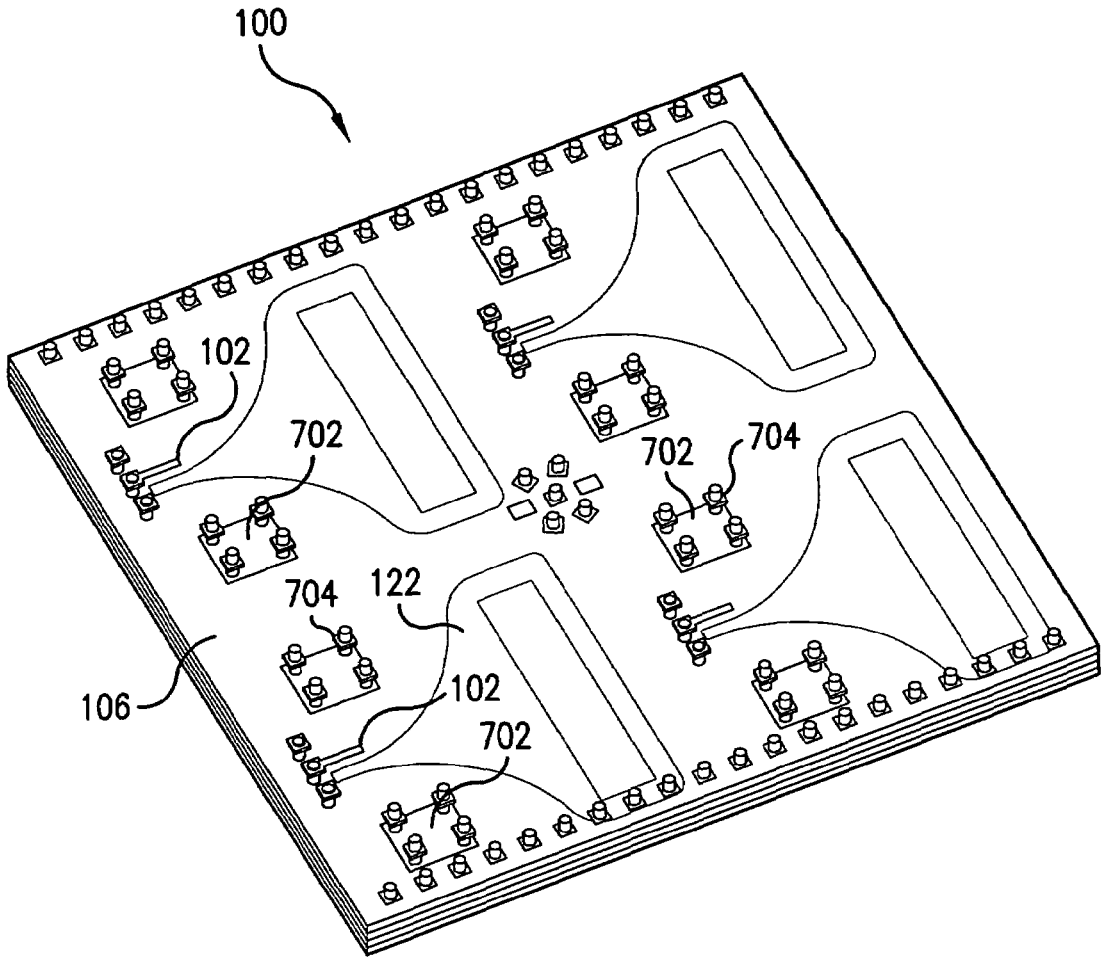
FIG. 7 is a perspective, top view of chip 100 according to some embodiments of the invention.

Referring now to FIG. 7, FIG. 7 is a perspective, top view of chip 100 according to some embodiments of the invention. To better illustrate the features of the chip, substrate 106 has been made transparent in the drawing. As shown in FIG. 7, chip 100 may have multiple signal transmission lines 102, and, for each transmission line 102, there may be a transmission line to waveguide transition for interconnecting the transmission line 102 to a waveguide.

Figure 8:
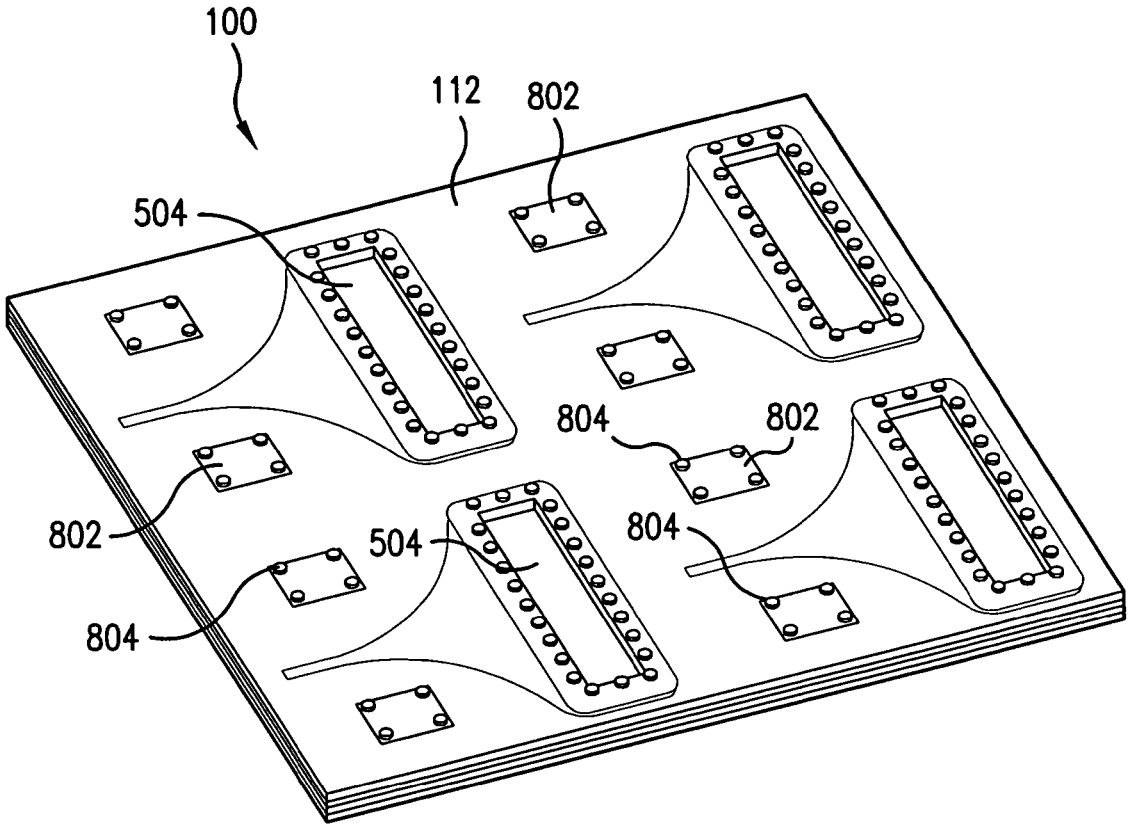
FIG. 8 is a perspective, bottom view of chip 100.

Referring now to FIG. 8, FIG. 8 is a perspective, bottom view of chip 100. Again, for the sake of illustration, substrate 112 has been made transparent.

As further shown in FIGS. 7 and 8, substrate 110 may include thermal pads 702 (see FIG. 7), substrate 112 may include thermal pads 802 (see FIG. 8), vias 704 (see FIG. 7) may extend from the top of substrate 106 to thermal pads 702, and vias 804 (see FIG. 8) may extend between thermal pads 702 and 802.

Figure 9:
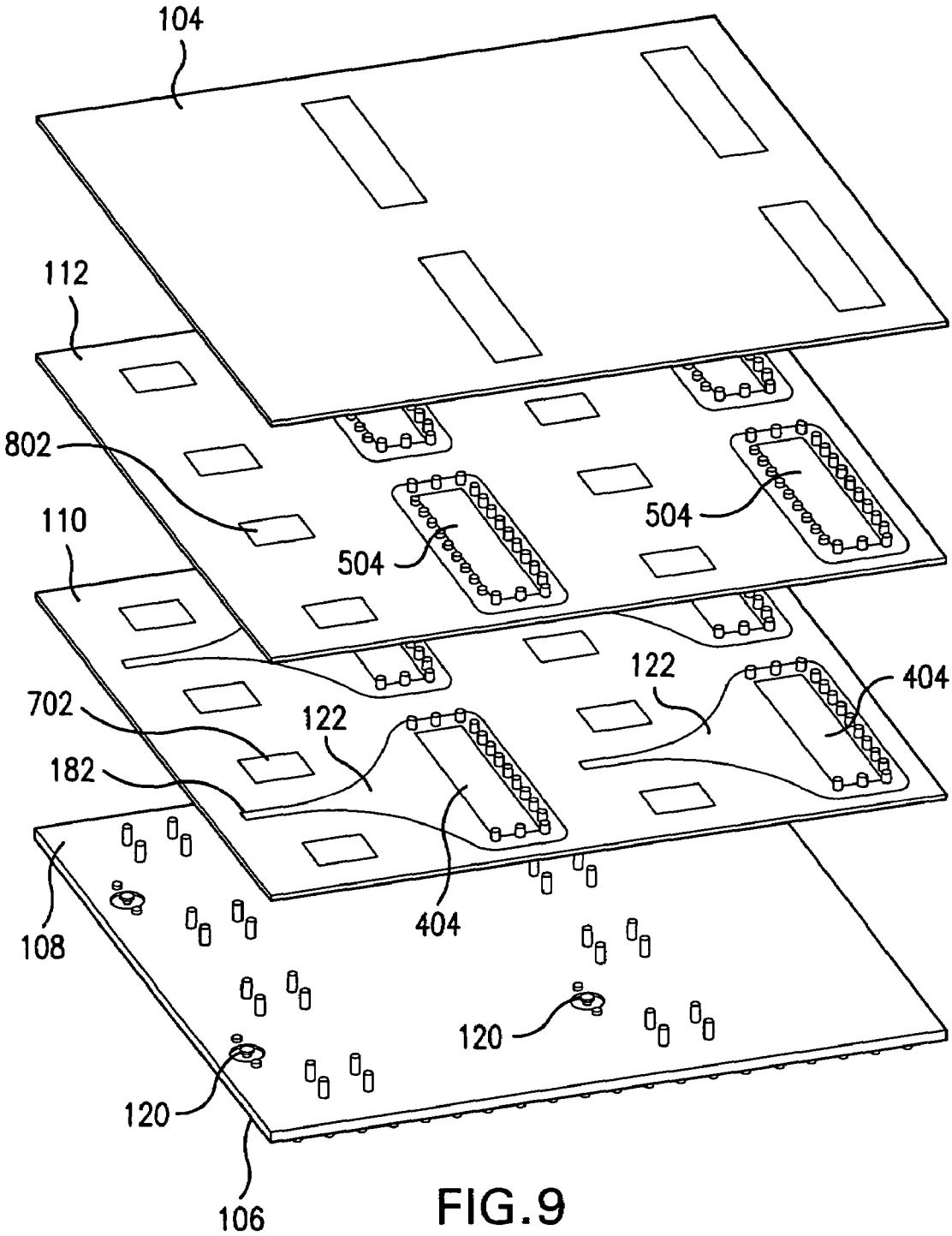
FIG. 9 is a perspective, exploded view of chip 100 and waveguide 104 according to some embodiments.

Referring now to FIG. 9, FIG. 9 is a perspective, exploded view of chip 100 and waveguide 104 according to some embodiments.

While various embodiments/variations of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. An apparatus, comprising:

a first substrate;

a first transmission line disposed on a top surface of the first substrate;

a second substrate;

a ground plane disposed between a bottom surface of the first substrate and a top surface of the second substrate;

a third substrate having a top surface that faces the bottom surface of the second substrate;

a second transmission line, having a first end and a second end, disposed between the bottom surface of the second substrate and the top surface of the third substrate, wherein the second transmission line widens from the first end to the second end;

a via in contact with an end of the first transmission line and in contact with the first end of the second transmission line, wherein the via passes through the first substrate, the ground plane and the second substrate; and a window disposed in the second end of the second transmission line.

2. The apparatus of claim 1, further comprising a window disposed in the third substrate.

3. The apparatus of claim 2, wherein the window disposed in the third substrate is directly beneath and aligned with the window disposed in the second transmission line.

4. The apparatus of claim 3, further comprising a second ground plane attached to the bottom surface of the third substrate.

5. The apparatus of claim 4, further comprising a plurality of vias that pass through the third substrate, wherein the plurality of vias are electrically connected between an end of the first transmission line and the second ground plane.

6. The apparatus of claim 5, further comprising a second plurality of vias, which pass through the second and third substrate, and which electrically connect the first ground plane, the second ground plane, and the second transmission line.

7. The apparatus of claim 1, wherein the second transmission line gradually widens from the first end to the second end.

8. The apparatus of claim 1, wherein the width of the first end of the second transmission line is a value X and the width of the second end of the second transmission line is at least 5 times the value X.

9. The apparatus of claim 1, wherein the first substrate is a GaAs substrate.

10. The apparatus of claim 9, wherein the second and third substrates comprise Benzocyclobutene.

11. A system, comprising:

a waveguide;

a signal transmission line disposed on the top of a substrate;

a transmission line to waveguide means for coupling the signal transmission line with the waveguide wherein the transmission line to waveguide means comprises: a first dielectric substrate, a second dielectric substrate, and a transition transmission line, having a first end and a second end, disposed between the first substrate and the second substrate, wherein the transition transmission line widens from the first end to the second end.

12. The system of claim 11, wherein the width of the first end of the transition transmission line is a value X and the width of the second end of the transition transmission line is at least 5 times the value X.

13. The system of claim 11, further comprising a ground plane disposed between a top surface of the first dielectric substrate and a bottom surface of the substrate on which the signal transmission line is disposed.

14. The system of claim 13, wherein the transmission line to waveguide means further comprises a via in contact with an end of the signal transmission line and in contact with the first end of the transition transmission line, wherein the via passes through the substrate on which the signal transmission line is disposed, the ground plane and the first dielectric substrate.

15. The system of claim 14, wherein the transmission line to waveguide means further comprises a window disposed in the second end of the transition transmission line.

16. The system of claim 15, further comprising a window disposed in the second dielectric substrate.

17. The system of claim 16, wherein the window disposed in the second dielectric substrate is directly beneath and aligned with the window disposed in the transition transmission line.

18. The system of claim 17, further comprising a second ground plane attached to the bottom surface of the second dielectric substrate.

19. The system of claim 18, further comprising a plurality of vias that pass through the second dielectric substrate, wherein the plurality of vias are electrically connected between an end of the signal transmission line and the second ground plane.

20. The system of claim 19, further comprising a second plurality of vias, which pass through the first and second dielectric substrates, and which electrically connect the first ground plane, the second ground plane, and the transition transmission line.

21. The system of claim 11, wherein the transition transmission line gradually widens from the first end to the second end.

22. The system of claim 11, wherein the substrate on which the signal transmission line is disposed is a GaAs substrate.

23. The system of claim 22, wherein the first and second dielectric substrates comprise Benzocyclobutene.

* * * * *